United States Patent [19]

Black

[11] Patent Number: 4,512,542

[45] Date of Patent: Apr. 23, 1985

[54] BOOK HOLDER

[76] Inventor: Maurice Black, 2412 S. Washington Ave., Saginaw, Mich. 48601

[21] Appl. No.: 426,280

[22] Filed: Sep. 29, 1982

[51] Int. Cl.[3] ..... A47B 97/04

[52] U.S. Cl. ..... 248/460; 248/451

[58] Field of Search ..... 248/460, 452, 441 R, 248/441 A, 445, 448, 451, 453, 459, 463, 458

[56] References Cited

U.S. PATENT DOCUMENTS

| | | | |
|---|---|---|---|
| 1,221,369 | 4/1917 | Osborn | 248/460 X |
| 1,376,272 | 4/1921 | Handley | 248/451 |
| 1,431,106 | 10/1922 | Edwards . | |
| 1,740,814 | 12/1929 | Hunter | 248/448 |
| 3,954,246 | 5/1976 | Sparkman | 248/460 |

FOREIGN PATENT DOCUMENTS

| | | | |
|---|---|---|---|
| 255059 | 6/1948 | Switzerland | 248/460 |
| 393866 | 6/1983 | United Kingdom | 248/460 |

*Primary Examiner*—J. Franklin Foss

*Attorney, Agent, or Firm*—Learman & McCulloch

[57] ABSTRACT

A book holder for holding a book in open condition at a selected page comprises a pair of elongate limbs extending in opposite directions from a central zone and terminating at their free ends in reversely turned, page engageable fingers extending alongside and spaced from the associated limb. The limbs are coupled together in such a manner as to enable them to be adjusted relative to each other and vary the distance between the fingers. Supporting legs may be connected to the limbs to enable the book holder to support a book at an inclination to the horizontal. The legs preferably are pivoted to one another and to the limbs so as to enable the limbs and legs to be folded to a small-size unit when the holder is not being used.

11 Claims, 12 Drawing Figures

BOOK HOLDER

BACKGROUND OF THE INVENTION

The prior art contains many examples of book holders that are adapted to hold a book open and prevent inadvertent turning of its pages. Most of the known devices include a body member which spans the spine of a book and has fingers or legs at its opposite ends which overlie the pages on opposite sides of the spine and near the latter. When turning a page of a book to which such a holder is applied, the reader must manipulate the page in such manner as to withdraw from beneath the fingers the page to be turned, and this necessitates moving the top or bottom edge of the page toward the opposite edge of the book. The closer that the finger lies to the spine of the book, the greater is the likelihood that the page will be torn. Thus, such book holders are difficult to use and frequently result in a book's being damaged.

Most known book holders also are symmetrical about a point midway between the page engaging fingers. If the fingers are located at the ends of bars which are pivoted to one another, the pivot structure oftentimes is located in a position to bear against the spine of the book. As a result, the pivot structure and the page-engaging fingers exert clamping forces on the book and impose compressive forces on the book's spine which can damage the binding and interfere with turning of the pages.

Others of the known book holders either do not provide for support of a book at a level conducive to reading comfort or if such support is provided, the supporting means are cumbersome and too bulky to permit comfortable, inconspicuous transport of the unit.

One of the objects of the present invention is to provide a book holder which overcomes the disadvantages of known book holders referred to above.

SUMMARY OF THE INVENTION

A book holder according to the invention has a pair of limbs which extend on opposite sides of a central zone and terminate at their free ends in reversely turned fingers which extend alongside of, but are spaced from the associated limbs. The limbs are adapted to extend along the two covers of an open book with the fingers overlying the side edges of the pages to which the book is opened. The limbs may be pivoted to one another or slideably connected to one another so as to enable the limbs to move relatively to one another between operative positions and an inoperative or storage position of compact size enabling the holder to be carried in a person's pocket or purse.

The zone at which the limbs are coupled to one another preferably is offset to one side of the mid-position between the fingers when the holder is in use. This construction permits the coupling to be offset to one side of the book's spine when the holder is in use, thereby preventing the structure of the coupling from bearing against the spine of the book and imposing forces thereon.

The book holder may be provided with legs capable of supporting the book at an inclination to the horizontal. Preferably the legs are pivoted to one another and to the limbs so as to enable the legs to be moved between erect and collapsed positions. The legs preferably also have two different supporting positions, one of which enables a book to be supported at a steeper incline to the horizontal than the other.

DESCRIPTION OF THE DRAWINGS

Preferred embodiments of the invention are illustrated in the accompanying drawings, wherein.

DETAILED DESCRIPTION

Figure 1:
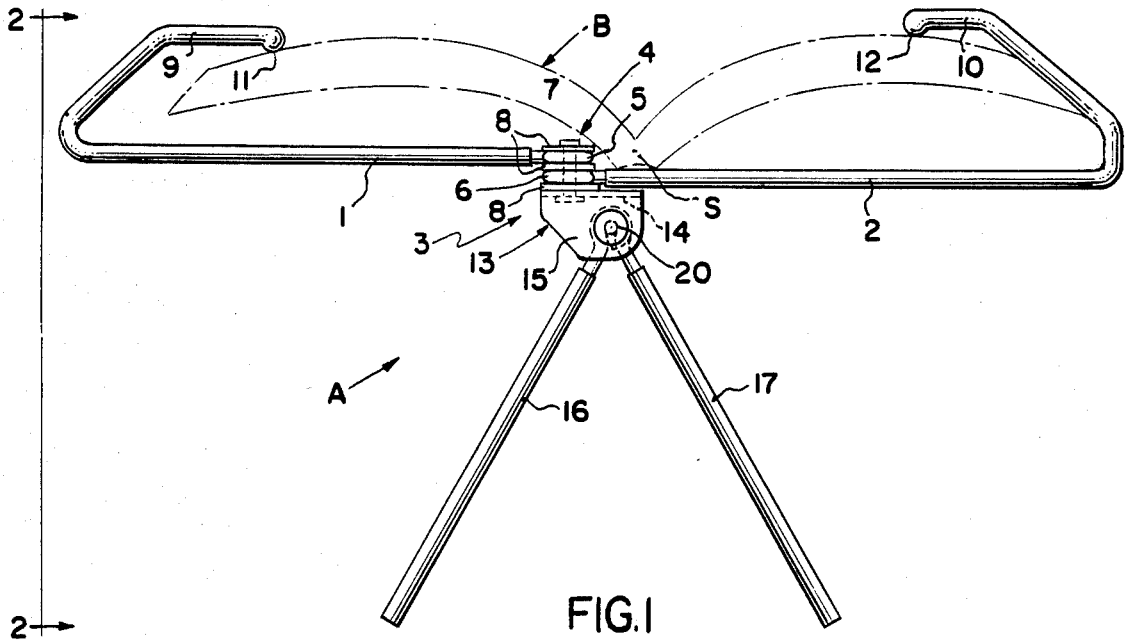
FIG. 1 is an elevational view of a book holder according to one embodiment of the invention.
Figure 2:
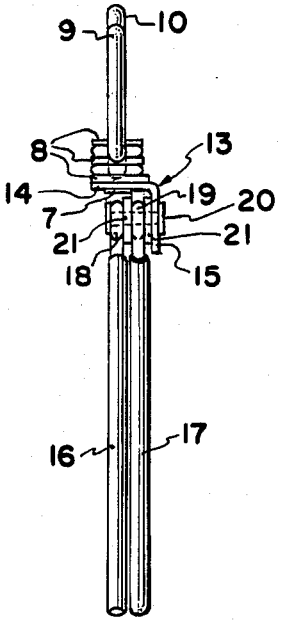
FIG. 2 is an elevational view taken along the line 2—2 of FIG. 1.

The book holder A illustrated in FIGS. 1–4 comprises a pair of elongate limbs 1 and 2 having corresponding ends pivotally coupled to one another at a generally central zone 3. The coupling 4 comprises loops 5 and 6 formed at the ends of the limbs 1 and 2, respectively, and through which extend a headed pivot pin 7. Friction, bellville, or other springy washers 8 flank each of the loops 5 and 6 so as to provide yieldable resistance to relative pivotal movement of the limbs 1 and 2.

The limb 1 terminates at its free end in a reversely turned finger 9 which extends alongside the limb 1 and is spaced from the latter. A similar finger 10 is provided at the free end of the limb 2. The finger 9 terminates at its free end in a bead 11 and a similar bead 12 is provided at the free end of the finger 10. Although the configuration of fingers 9 and 10 is similar, the beaded end 12 of the finger 10 is spaced further from the limb 2 than the beaded end of the finger 9 is spaced from the limb 1. The purpose of this construction will be explained shortly.

The book holder illustrated in FIGS. 1–4 preferably includes an L-shaped connector 13 having one flange 14 connected to the limbs 1 and 2 by the pivot pin 7 and having a second flange 15 connected to a pair of support legs 16 and 17. The legs 16 and 17 have loops 18 and 19 at corresponding ends through which extends a headed pivot pin 20 which also extends through the flange 15 of the connector 13. Friction or springy washers 21 flank the loop 19 to provide yieldable resistance against relative rotation of the legs.

Figure 3:
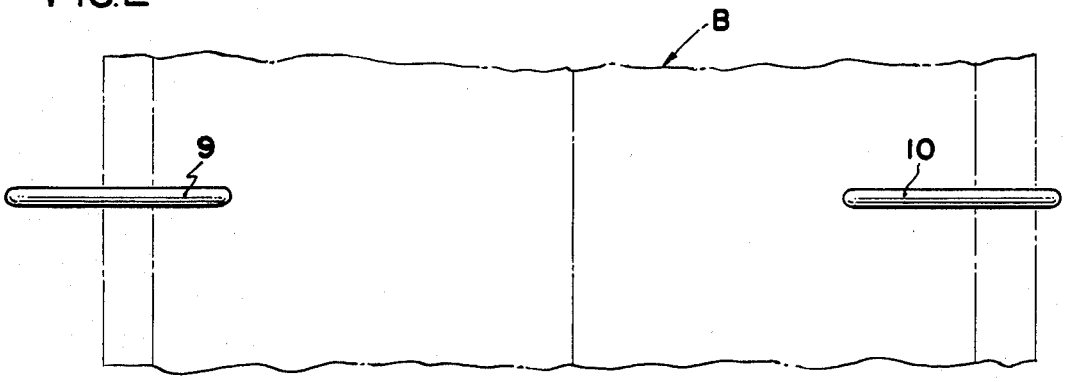
FIG. 3 is a plan view illustrating the holder as it would appear to a reader when applied to a book.

To condition the apparatus for use, the limbs 1 and 2 are rotated so that they extend in opposite directions from the central zone 3. A book B then may be opened so that one side can be fitted under the finger 9 and the opposite side fitted under the finger 10, as is shown in FIGS. 1 and 3. Preferably, the limb 2 is longer than the limb 1, thereby enabling the pivotal coupling 3 to lie to one side of the book's spine S and avoid imposing, together with the fingers 9 and 10, stresses on the book which would tend to crack or rupture the spine. This construction also enables the book to assume a flatter position within the book holder.

When the book holder A is applied to the book B, a page may be removed from beneath the finger 10 by sliding the page to the left, or in the direction of the spine S, and inserted under the finger 9 by sliding the page toward the left-hand edge of the book. Thus, movement of a page from beneath the finger to the position beneath the finger 9 need not impose any forces on the page tending to tear it.

If the holder is equipped with the support legs 16 and 17, the latter may be swung to the positions illustrated in FIG. 1 so as to provide support for the book B. If the holder is applied to the book adjacent its upper end, the legs 16 and 17 will support the book at an inclination to the horizontal, with the upper edge of the book being located at the higher level.

Figure 4:
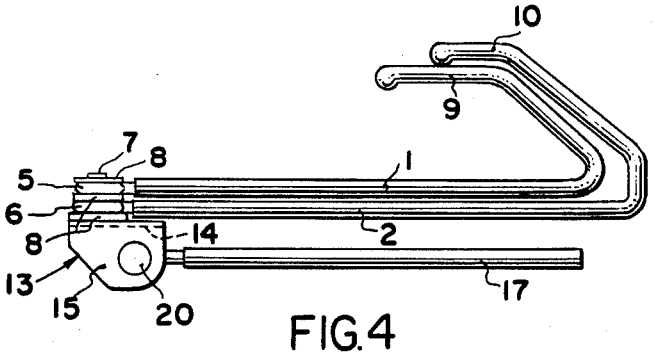
FIG. 4 is an elevational view illustrating the parts of the holder in folded or collapsed condition.

When the book holder A is not in use, the legs 16 and 17 may be collapsed and swung to the position indicated in FIG. 4, and the limbs 1 and 2 also may be swung to the position illustrated in FIG. 4. The difference in lengths of the limbs 1 and 2, together with the difference in spacing between the fingers and their respective limbs, enables the finger 9 to nest with the finger 10 thereby resulting in a compact size unit which conveniently may be carried in a person's pocket or purse.

Figure 5:
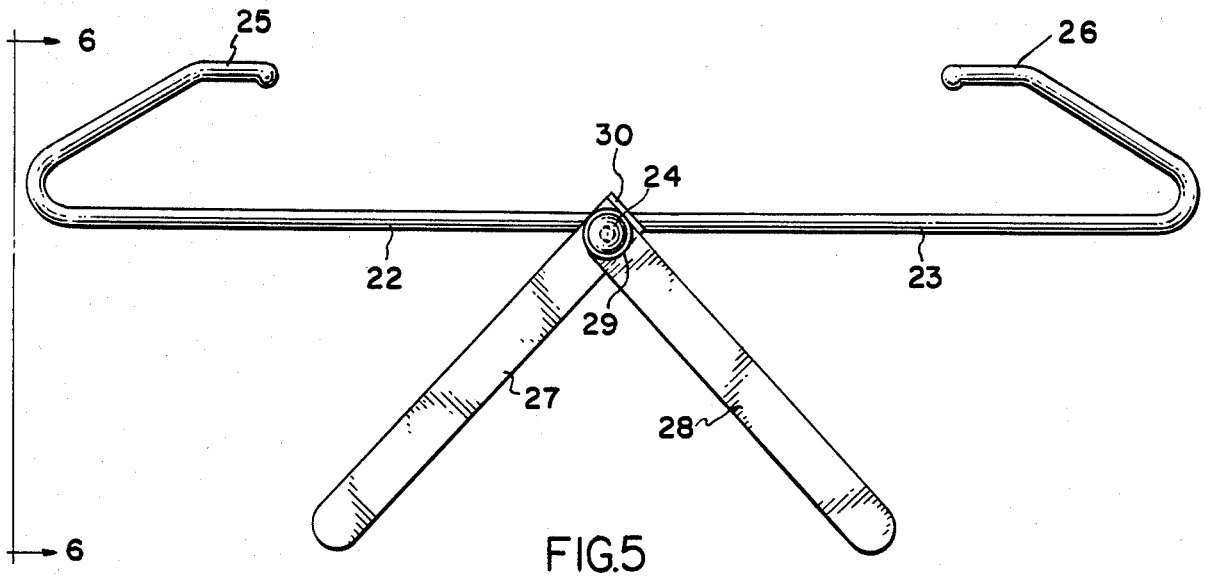
FIG. 5 is an elevational view of a modified embodiment.
Figure 6:
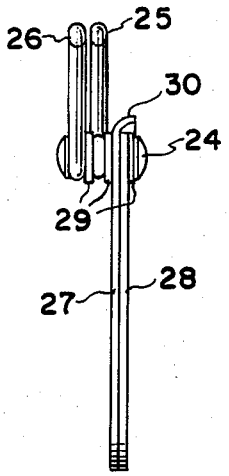
FIG. 6 is a side elevational view of the holder of FIG. 5 as viewed in the direction of the arrows 6—6.
Figure 7:
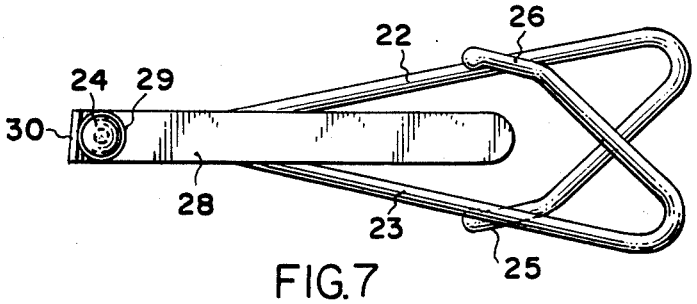
FIG. 7 is a plan view illustrating the parts in the positions they occupy when the apparatus is collapsed.

The embodiment illustrated in FIGS. 5–7 comprises a pair of elongate limbs 22 and 23 similar to the limbs 1 and 2 and coupled at corresponding ends by a headed pivot pin 24 that extends through loops and washers similar to the loops 5, 6 and the washers 8. In the modified embodiment the limbs 22 and 23 are of equal length, but they could be of different length, if desired. The limb 22 terminates at its free end in a reversely turned finger 25 and the limb 23 terminates at its free end in a reversely turned finger 26, the fingers 25 and 26 extending alongside of, but being spaced from the respective limbs.

The pivotal coupling of the limbs 22 and 23 enables the limb 22 to be swung clockwise from the position shown in FIG. 5 to the position shown in FIG. 7 so as to collapse the holder.

The embodiment of FIGS. 5–7 may include a pair of support legs 27 and 28 each of which is connected to the limbs 22 and 23 by the pivot pin 24 and friction or springy washers 29. The leg 27 is provided with a flange 30 at that end adjacent the pivot 24 and which overlies the leg 28. The flange 30 engages the leg 28 when the latter has been rocked counterclockwise relative to the leg 27 to the position shown in FIG. 5 and limits further counterclockwise movement thereof. There is sufficient clearance between the end of the leg 28 adjacent the pivot 24 and the flange 30, however, to enable the leg 28 to be pivoted freely from a position overlying the leg 27 to the position shown in FIG. 5, and vice versa. Thus, the legs 27 and 28 may be pivoted relative to each other and relative to the limbs 22 and 23 to the positions shown in FIG. 7 so as to enable the book holder to be collapsed to a compact size when not in use.

Figure 8:
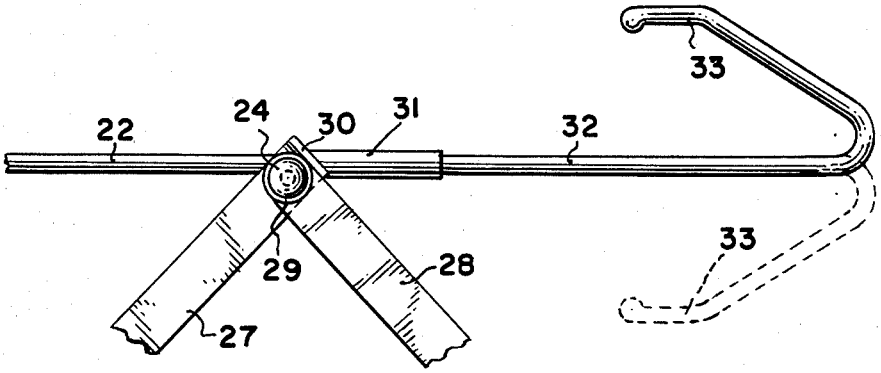
FIG. 8 is a fragmentary view similar to FIG. 5, but illustrating another embodiment.

The embodiment shown in FIG. 8 is the same as that shown in FIGS. 5–7 with the exception that the limb 23 is replaced by a sleeve 31 having one end coupled to the pivot pin 24 and its other end receiving one end of a limb 32, the opposite end of which has a finger 33 corresponding to the finger 26. The limb 32 is rotatable about its longitudinal axis in the sleeve 31 so as to enable the finger 33 to occupy either of the positions shown in whole lines or dash lines in FIG. 8. The ability of the limb 32 to rotate makes it possible to swing the limb 22 to a position alongside the limb 32 and have the fingers 25 and 33 parallel to each other, thereby further minimizing the collapsed size of the holder. Any suitable means may be employed to prevent withdrawal of the limb 32 from the sleeve 31, if it is desired to preclude withdrawal.

The embodiment illustrated in FIGS. 9–12 comprises a pair of elongate limbs 34 and 35 coupled to one another for sliding movement by means of a saddle-shaped connector 36 in which the limb 34 is slideably accommodated. The limb 35 has at one end a loop 37 through which a pivot pin 38 extends, the pivot pin also extending through the connector 36 and through springy or friction washers 39 which yieldably resist relative sliding movement of the limbs. The limbs 34 and 35 also include page engaging fingers 40 and 41, respectively, corresponding to those described earlier.

If desired, the pivot pin 38 may be replaced by a screw on which a wing or knurled nut is mounted to impose variable friction forces on the joint.

The holder illustrated in FIGS. 9–12 also may include a pair of support legs 42 and 43 joined to the connector 36 via the pivot pin 38 and an additional washer 44 like the washers 39. The leg 43 also includes at that end adjacent the pivot 38 a rotation limiting flange 45 similar to the flange 30. Rather than extending normal to the longitudinal axis of the leg 43, the flange 45 extends at an angle of about 30° to the longitudinal axis. Thus, if the legs 42 and 43 are swung to the positions shown in FIG. 9, the angle between the legs 42, 43 is acute inasmuch as the engagement between the flange 45 and the leg 43 limits further rotation of the legs away from one another. On the other hand, if the legs 43 and 44 are swung to the positions shown in FIG. 11, the angularity of the flange 45 enables the angle between the legs 43 and 44 to be obtuse, and the flange 45 limits further swinging movement of the legs 43 and 44 in a direction to move them apart. The angular flange 45 thus enables the legs to support a book at either of two different levels of inclination relative to the horizontal.

Figure 12:
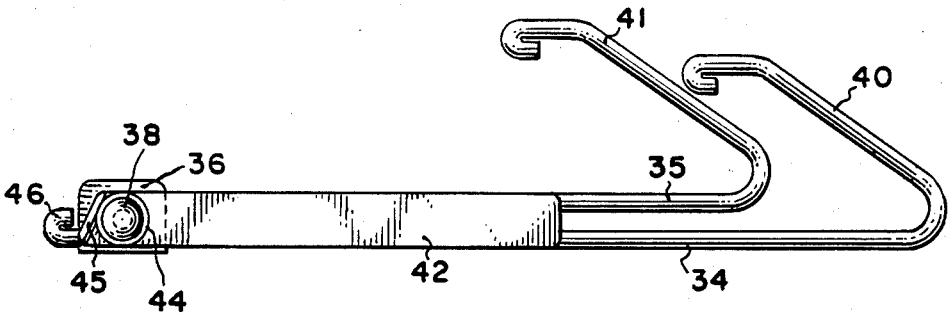
FIG. 12 is an elevational view illustrating parts of the apparatus in collapsed condition.

The legs 42 and 43 also may be swung to overlying positions, as shown in FIG. 12 and then swung as a unit to a position parallel to the limbs 34 and 35 so as to provide a compact unit when the holder is not in use.

Figure 9:
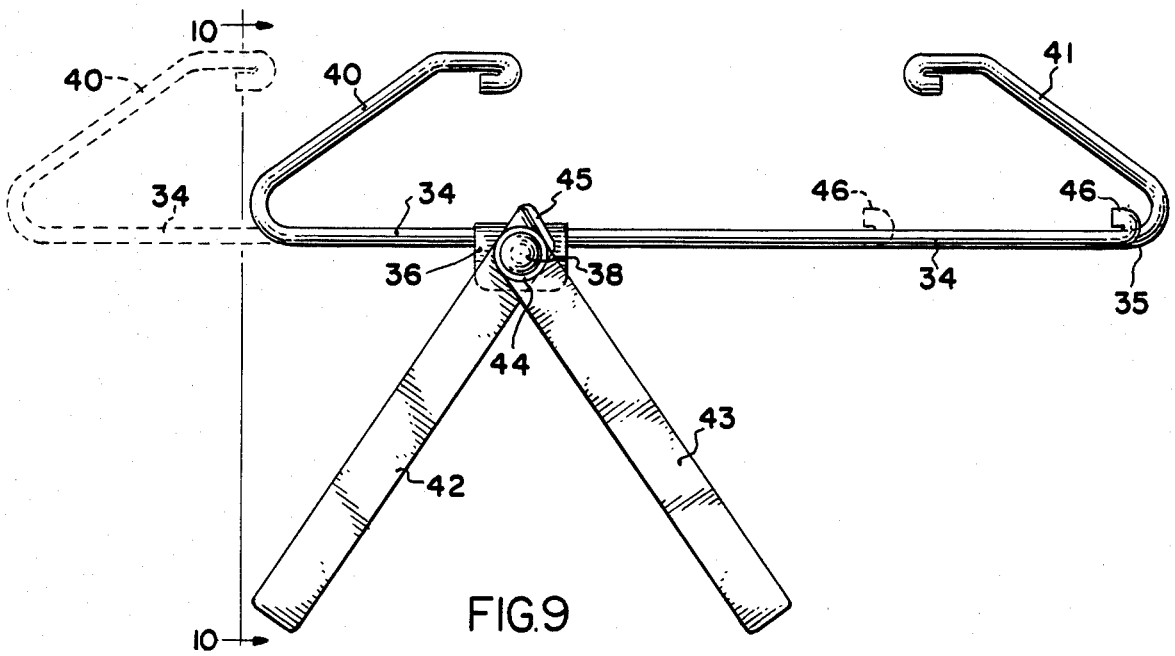
FIG. 9 is an elevational view of a further embodiment.
Figure 10:
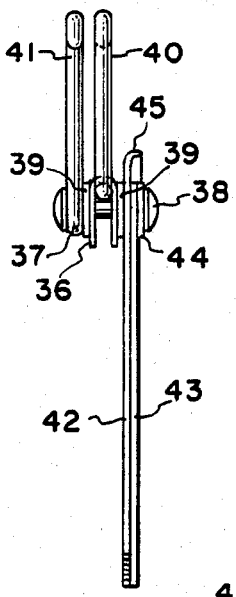
FIG. 10 is a side elevational view taken along the line 10—10 of FIG. 9.
Figure 11:
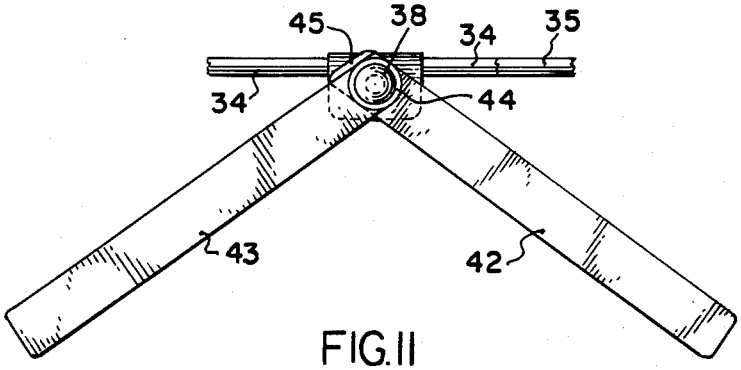
FIG. 11 is a fragmentary view similar to FIG. 9, but illustrating the parts in adjusted positions.

The limbs 34 and 35 may occupy several different positions of sliding adjustment, as is indicated in FIG. 9. The limb 34 also can be slid to the left to the dotted line position shown in FIG. 9 so as to increase the distance between the fingers 40 and 41. The extent to which the limb 34 may be slid to the left is determined by a stop 46 at that end of the limb opposite the finger 40. The stop 46 is adapted to engage the connector 36 and prevent inadvertent withdrawal of the limb 34 from the connector 36.

In each of the disclosed embodiments the ability of the limbs to be adjusted in such manner as to vary the distance between the page engageable fingers enables the holder to accommodate books of considerably varying size, as well as to be collapsed when not in use.

This disclosure is representative of presently preferred embodiments of the invention, but is intended to be illustrative rather than definitive thereof. The invention is defined in the claims.

I claim:

1. A book holder comprising a pair of limbs extending in opposite directions from a central zone; a reversely turned finger at the free end of each of said limbs extending alongside and spaced from the associated limb, the spacing between one finger and its limb being less than that between the other of said fingers and its limb by an amount sufficient to enable said one finger to nest with the other of said fingers; and means coupling said limbs to one another at said zone and enabling relative movement between said limbs in such manner as to move said limbs between a number of positions, one of said limbs being longer than the other by such an amount that in one of said positions of said limbs said one finger nests with the other of said fingers.

2. A holder according to claim 1 wherein said coupling means comprises a pivotal connection betweeen said limbs.

3. A holder according to claim 1 wherein said coupling means comprises a slideable connection between said limbs.

4. A holder according to claim 1 wherein one of said limbs is longer than the other of said limbs.

5. A holder according to claim 1 wherein each of said fingers has a beaded free end.

6. A holder according to claim 1 including a pair of support legs; and means connecting said legs at corresponding ends to said limbs.

7. A holder according to claim 6 wherein said connecting means is pivotal.

8. A holder according to claim 6 including pivotal means connecting said legs to one another.

9. A holder according to claim 8 including means for limiting relative pivotal movement of said legs in each of two opposite directions.

10. A holder according to claim 9, wherein said limiting means enables greater relative pivotal movement of said legs in one direction than in the opposite direction.

11. A holder according to claim 1 wherein one of said limbs is rotatable about its longitudinal axis.

* * * * *